US011911647B2

(12) United States Patent
Rothschild

(10) Patent No.: US 11,911,647 B2
(45) Date of Patent: Feb. 27, 2024

(54) MODIFIED WEIGHT TRAINING EQUIPMENT

(71) Applicant: Sound Shore Innovations L.L.C., Darien, CT (US)

(72) Inventor: Kyle D. Rothschild, Darien, CT (US)

(73) Assignee: Sound Shore Innovations L.L.C., Darien, CT (US)

( * ) Notice: Subject to any disclaimer, the term of this patent is extended or adjusted under 35 U.S.C. 154(b) by 0 days.

(21) Appl. No.: 17/153,396

(22) Filed: Jan. 20, 2021

(65) Prior Publication Data

US 2021/0275853 A1 Sep. 9, 2021

Related U.S. Application Data

(62) Division of application No. 15/885,292, filed on Jan. 31, 2018, now Pat. No. 11,260,257.

(51) Int. Cl.

| | |
|---|---|
| ***A63B 21/06*** | (2006.01) |
| ***A63B 21/072*** | (2006.01) |
| ***A63B 71/00*** | (2006.01) |

(52) U.S. Cl.

CPC ..... *A63B 21/0607* (2013.01); *A63B 21/0604* (2013.01); *A63B 21/072* (2013.01);

(Continued)

(58) Field of Classification Search

CPC ..... A63B 21/0004; A63B 21/00061; A63B 71/0054; A63B 2071/0063;

(Continued)

(56) References Cited

U.S. PATENT DOCUMENTS 1,033,056 A 7/1912 Richert
3,226,117 A * 12/1965 Walklet ..... A63B 21/0603 482/106

(Continued)

FOREIGN PATENT DOCUMENTS

CN 3191234 6/2001
CN 2506298 Y 8/2002

(Continued)

OTHER PUBLICATIONS

Omnexus by SpecialChem, "Hardness Shore D", Wayback Machine Archive Date Aug. 11, 2016, 3 pages, retrieved from the Internet: https://omnexus.specialchem.com/polymer-properties/properties/hardness-shore-d (Year: 2016).*

(Continued)

*Primary Examiner* — Loan B Jimenez
*Assistant Examiner* — Kathleen M Fisk
(74) *Attorney, Agent, or Firm* — Jones Day

(57) ABSTRACT

A weight object configured to be lifted from a ground surface includes a first portion made of high-durometer material, a second portion made of elastomeric material having lower durometer than the first portion, and a handle for holding the weight object and lifting the object from the ground surface, where the second portion includes spaced holes within the elastomeric material for absorbing noise generated when the weight object is dropped on the ground surface. Alternatively, a weight object is disclosed which is configured to be lifted from a ground surface, comprising at least one layer of elastomeric material having spaced holes therein for absorbing noise generated when the weight object is dropped on the ground surface, and an opening configured to receive a handle.

18 Claims, 11 Drawing Sheets

(52) U.S. Cl.
CPC ..... *A63B 21/0724* (2013.01); *A63B 21/0726* (2013.01); *A63B 71/0054* (2013.01); *A63B 2071/0063* (2013.01)

(58) Field of Classification Search
CPC ..... A63B 21/06–08; A63B 2244/09; A63B 2225/01; A63B 2209/00
See application file for complete search history.

(56) References Cited

U.S. PATENT DOCUMENTS 3,606,410 A 9/1971 Inserra
3,790,922 A 2/1974 Normann
D255,263 S 6/1980 Mandon et al.
D279,495 S 7/1985 Barbeau
D280,433 S 9/1985 Lincir
D287,387 S 12/1986 Oliver et al.
4,639,979 A 2/1987 Polson
4,738,446 A 4/1988 Miles
4,773,641 A 9/1988 Metz
4,817,944 A 4/1989 Anderson et al.
4,893,810 A 1/1990 Lee
D314,422 S 2/1991 Adorjan
5,033,740 A 7/1991 Schwartz et al.
5,108,066 A 4/1992 Lundstrom
5,137,502 A 8/1992 Anastasi
5,163,887 A 11/1992 Hatch
D346,433 S 4/1994 Cooper
D354,322 S 1/1995 Vodhanel, Jr.
D355,007 S 1/1995 Rojas et al.
D381,611 S 7/1997 Ohata et al.
D394,685 S 5/1998 Eckmann
D405,484 S 2/1999 Rojas et al.
D406,183 S 2/1999 Zovich
D409,266 S 5/1999 Rojas et al.
D409,695 S 5/1999 Rojas et al.
6,014,078 A 1/2000 Rojas et al.
D421,076 S 2/2000 Lincir
D424,140 S * 5/2000 Lincir ..... D21/680
D424,639 S 5/2000 Rojas et al.
D428,947 S 8/2000 Harms et al.
D433,468 S 11/2000 Rojas et al.
D433,469 S 11/2000 Rojas et al.
D433,720 S 11/2000 Rojas et al.
D433,721 S 11/2000 Rojas et al.
D434,090 S 11/2000 Wallace et al.
D437,015 S 1/2001 Rojas et al.
D439,290 S 3/2001 Rojas et al.
D441,412 S 5/2001 Rojas et al.
D441,812 S 5/2001 Rojas et al.
D442,239 S 5/2001 Rojas et al.
D442,240 S 5/2001 Rojas et al.
D442,654 S 5/2001 Buchanan
D445,153 S 7/2001 Lincir
D445,154 S 7/2001 Lincir
D445,854 S 7/2001 Harms et al.
D446,265 S 8/2001 Lincir
D446,559 S 8/2001 Lincir
D448,055 S 9/2001 Lien et al.
D450,361 S 11/2001 Harms et al.
D451,158 S * 11/2001 Lincir ..... D21/680
D451,159 S 11/2001 Rojas et al.
D451,160 S 11/2001 Rojas et al.
6,319,176 B1 11/2001 Landfair
D454,167 S 3/2002 Lincir
6,436,015 B1 8/2002 Frasco et al.
D463,001 S 9/2002 Buchanan
D474,517 S 5/2003 Harms
D476,383 S 6/2003 Chen
D480,969 S 10/2003 Owens
D483,083 S * 12/2003 Allshouse ..... D21/680
6,702,723 B2 3/2004 Landfair
6,736,765 B2 * 5/2004 Wallace ..... A63B 21/072 482/106
6,746,380 B2 6/2004 Lien et al.
D494,451 S 8/2004 Winig et al.
D496,414 S 9/2004 Harms et al.
6,837,833 B2 1/2005 Elledge
D502,514 S 3/2005 Buchanan et al.
6,875,161 B1 4/2005 Brice
D504,923 S 5/2005 Harms et al.
6,893,385 B2 * 5/2005 Smithberg ..... A63B 71/0054 482/93
D511,366 S 11/2005 Brown
6,991,590 B2 * 1/2006 Vigiano ..... A63B 21/072 482/106
D516,639 S 3/2006 Hamilton
D519,584 S 4/2006 Brice et al.
7,174,934 B2 * 2/2007 Hill, III ..... B60C 7/10 152/324
7,198,591 B2 * 4/2007 Lien ..... A63B 21/0728 482/106
7,207,929 B2 4/2007 Hamilton
7,300,389 B2 11/2007 Lien et al.
D562,415 S 2/2008 Xu et al.
D562,919 S 2/2008 Hillson
D566,207 S 4/2008 Cao
D566,208 S 4/2008 Alessandri et al.
D566,209 S 4/2008 Alessandri et al.
D568,423 S 5/2008 Y'shua et al.
D572,320 S 7/2008 Davies, III
D573,207 S 7/2008 Davies, III
D573,208 S 7/2008 Davies, III
7,517,305 B2 4/2009 Lien
D599,881 S 9/2009 Wang et al.
D606,133 S 12/2009 Lien
7,625,322 B1 12/2009 Krull
D609,526 S 2/2010 Tuttle
D611,524 S 3/2010 Lawrence, III
7,704,196 B2 4/2010 Lien et al.
D615,605 S 5/2010 Frasco et al.
D628,248 S 11/2010 Januszek
7,828,702 B2 11/2010 Lien et al.
D631,142 S 1/2011 Angell
D637,697 S 5/2011 Steiner
D639,874 S 6/2011 Hillson
D643,075 S 8/2011 Childs
D660,928 S 5/2012 Guarrasi
D662,558 S 6/2012 Lovegrove et al.
8,282,138 B2 10/2012 Steiner
D673,230 S 12/2012 Qin
D684,224 S 6/2013 Davies, III
D688,759 S 8/2013 Davies, III
D692,969 S 11/2013 Davies, III
D695,128 S 12/2013 Ozsinmaz
D722,348 S 2/2015 Kessler
9,005,088 B2 * 4/2015 Sides, Jr. ..... A63B 21/4005 482/106
D732,613 S 6/2015 Davies, III
D736,884 S 8/2015 Lovley, II et al.
9,109,616 B1 8/2015 Ballentine
9,126,077 B2 9/2015 Rothacker
D743,519 S 11/2015 Furner
D749,177 S 2/2016 Childs
D749,889 S 2/2016 Magistro
D751,157 S 3/2016 Irwin et al.
D751,940 S 3/2016 Vaughan et al.
9,358,414 B2 6/2016 Dephouse
9,364,704 B1 6/2016 Kuka
D763,658 S 8/2016 Grasselli et al.
D764,608 S 8/2016 Jones
D766,384 S 9/2016 Jones
9,440,404 B2 * 9/2016 Martin ..... B29D 30/02
D771,205 S 11/2016 Davies, III
9,504,869 B2 11/2016 Gavigan
D777,266 S 1/2017 Davies, III
D780,859 S 3/2017 Ramsey et al.
D780,860 S 3/2017 Jones
D780,861 S 3/2017 Jones
D788,886 S 6/2017 Salzer
9,682,268 B2 6/2017 Breitkreutz et al.
D795,971 S 8/2017 Patti
9,751,270 B2 9/2017 Thompson et al.
D798,968 S 10/2017 Lien

(56) References Cited

U.S. PATENT DOCUMENTS

| | | | | |
|---|---|---|---|---|
| D799,939 | S | 10/2017 | Lowitz | |
| D802,689 | S | 11/2017 | Lien | |
| D810,849 | S | 2/2018 | Chong | |
| D816,780 | S | 5/2018 | Beekzad | |
| D821,175 | S | 6/2018 | Grasselli et al. | |
| 10,040,259 | B2 | 8/2018 | Lister et al. | |
| 10,076,679 | B2 | 9/2018 | Dickerson | |
| D831,134 | S | 10/2018 | Hillson | |
| D834,115 | S | 11/2018 | Gilbert | |
| D842,399 | S | 3/2019 | Arceta | |
| D842,941 | S | 3/2019 | Brezovar | |
| D843,524 | S | 3/2019 | Henniger | |
| 10,226,659 | B2 | 3/2019 | Stilson | |
| D851,711 | S | 6/2019 | Brezovar | |
| D852,637 | S | 7/2019 | Becerra | |
| D854,636 | S | 7/2019 | Nelson | |
| D856,447 | S | 8/2019 | Dunahay | |
| D857,131 | S | 8/2019 | Marton et al. | |
| D862,617 | S | 10/2019 | Henniger et al. | |
| 10,456,655 | B1 | 10/2019 | Orehek | |
| D865,881 | S | 11/2019 | Muir et al. | |
| 10,537,777 | B1 | 1/2020 | Tash et al. | |
| 10,773,117 | B1 | 9/2020 | Goldberg et al. | |
| 2003/0083179 | A1* | 5/2003 | Landfair | A63B 21/072 482/93 |
| 2003/0162637 | A1 | 8/2003 | Smithberg | |
| 2004/0077466 | A1 | 4/2004 | Wallace et al. | |
| 2004/0092370 | A1* | 5/2004 | Lincir | A63B 21/072 482/93 |
| 2004/0166997 | A1 | 8/2004 | Vigiano | |
| 2005/0026754 | A1 | 2/2005 | Lien et al. | |
| 2006/0073948 | A1* | 4/2006 | Lincir | A63B 21/06 482/106 |
| 2006/0293155 | A1 | 12/2006 | Hamilton | |
| 2007/0027007 | A1 | 2/2007 | Frasco | |
| 2007/0138351 | A1 | 6/2007 | Wu | |
| 2007/0142188 | A1 | 6/2007 | Lien | |
| 2007/0184943 | A1* | 8/2007 | Davies | A63B 21/0724 482/93 |
| 2008/0050260 | A1 | 2/2008 | Iwanami et al. | |
| 2008/0153678 | A1 | 6/2008 | McClusky | |
| 2008/0200316 | A1 | 8/2008 | Shillington | |
| 2008/0287271 | A1 | 11/2008 | Jones | |
| 2009/0118105 | A1 | 5/2009 | Schiff | |
| 2009/0192025 | A1 | 7/2009 | Minerva | |
| 2009/0239719 | A1 | 9/2009 | Patti | |
| 2009/0258766 | A1 | 10/2009 | Patti | |
| 2009/0270233 | A1 | 10/2009 | Cao | |
| 2010/0022359 | A1 | 1/2010 | Lin | |
| 2010/0125030 | A1 | 5/2010 | Shifferaw | |
| 2010/0132858 | A1* | 6/2010 | Arakawa | B60B 9/10 152/7 |
| 2011/0021327 | A1 | 1/2011 | Lien | |
| 2012/0038207 | A1* | 2/2012 | Williams | B60C 7/18 301/37.23 |
| 2012/0094810 | A1 | 4/2012 | Anderson | |
| 2012/0234444 | A1 | 9/2012 | Palinkas et al. | |
| 2013/0165300 | A1 | 6/2013 | Richards | |
| 2014/0024504 | A1 | 1/2014 | Potts et al. | |
| 2014/0162850 | A1 | 6/2014 | Chen | |
| 2014/0194258 | A1 | 7/2014 | Shorter | |
| 2014/0200119 | A1 | 7/2014 | Sides, Jr. | |
| 2014/0256521 | A1 | 9/2014 | Davies, III | |
| 2014/0274595 | A1 | 9/2014 | Patti | |
| 2014/0311643 | A1* | 10/2014 | Amstutz | B29C 70/78 264/250 |
| 2015/0011369 | A1 | 1/2015 | Peritz | |
| 2015/0165258 | A1 | 6/2015 | Januszek | |
| 2015/0231441 | A1 | 8/2015 | Davies, III | |
| 2016/0051856 | A1 | 2/2016 | Breitkreutz et al. | |
| 2017/0113088 | A1 | 4/2017 | Hollingshead | |
| 2017/0149269 | A1 | 5/2017 | Rojas et al. | |
| 2017/0151460 | A1 | 6/2017 | Jennings et al. | |
| 2017/0258661 | A1 | 9/2017 | Bradford | |
| 2017/0304671 | A1 | 10/2017 | Hill | |
| 2018/0028857 | A1 | 2/2018 | Rothschild et al. | |
| 2018/0272175 | A1 | 9/2018 | Henniger | |
| 2019/0038927 | A1 | 2/2019 | Wilhelm et al. | |
| 2019/0111304 | A1 | 4/2019 | Gilman | |
| 2019/0143742 | A1 | 5/2019 | Ferry | |
| 2019/0232100 | A1 | 8/2019 | Rothschild | |
| 2020/0360755 | A1 | 11/2020 | Rothschild | |
| 2020/0384307 | A1 | 12/2020 | Bowers | |
| 2020/0398097 | A1 | 12/2020 | Chen | |
| 2021/0135540 | A1 | 5/2021 | Zhang | |

FOREIGN PATENT DOCUMENTS

| | | | |
|---|---|---|---|
| CN | 2512467 | Y | 9/2002 |
| CN | 201248992 | Y | 6/2009 |
| CN | 303340060 | | 8/2015 |
| CN | 303896560 | | 10/2016 |
| CN | 304438760 | | 1/2018 |
| EM | 003110402-0001 | | 7/2016 |
| EM | 007065669-0001 | | 10/2019 |
| ES | 1038081 | | 5/1998 |
| FR | 2459056 | A1 | 1/1981 |

OTHER PUBLICATIONS

Bird, Scott Andrew, "How to make your own bumper plates on a budget", Wayback Machine Archive Date May 22, 2011, 5 pages, retrieved from the Internet: https://straighttothebar.com/articles/2007/09/how_to_make_your_own_bumper_pl/ (Year: 2011).*

A Guide to Buying Steel Powerlifting Plates & Discs, from https://www.garage-gyms.com/steel-powerlifting-weight-plates-discs-guide-review/, dated Nov. 16, 2017.

Body Solid Rubber Grip Olympic Sets, from https://www.bodysolid.com/home/osr/rubber_grip_olympic_sets, dated Nov. 30, 2021.

Bodypower 10kg Tri Grip Vinyl Standard (1 Inch) Weight Disc Plates: Published Jun. 10, 2013 [online], site visited Nov. 22, 2021. Available from Internet URL: https://www.amazon.co.uk/dp/B00E4WH2NS/ref=cm sw r tx dp U x Fpf5DbMHT60MN (Year: 2013).

BodyRip Olympic Polygonal Weight Plates: Published Feb. 3, 2015 [online], site visited Nov. 22, 2021. Available from Internet URL: https://www.amazon.co.uk/dp/B00T4GM5W2/ref=cm_sw_r_tw_dp_U_x_ASg5DbMR69J5P (Year: 2015).

BodyRip Polygonal Weight Plates 1×10kg BodyRip: Published Feb. 7, 2014 [online], site visited Nov. 22, 2021. Available from Internet URL: https://www.amazon.co.uk/dp/B00IARQAWW/ref=cm_sw_r_tw_dp_U_x_5If5DbXR685AX (Year: 2014).

CAP Barbell Weight Plates listing from http://web.archive.org/web/20180103173524/http://capbarbell.com/strength/weight-plates, dated Jan. 3, 2018, accessed Nov. 22, 2021.

Hampton Fit Weight Plates, from https://www.hamptonfit.com/product-category/plates/, dated Nov. 30, 2021.

International Search Report dated May 24, 2019 of International application No. PCT/US2019/015813.

International Search Report & Written Opinion dated Mar. 10, 2020 of International application No. PCT/US2019/064237.

Photo of York Olympic Standard Barbell Weight Plates, from https://external-preview.redd.it/GeIL3ODNpQ8Rv7Xu1vfzNyPzFSSd1jn9crrZ4i5T5-4.jpg?auto=webp&s=d87da24a6c3837e0e90f9088b366c7781fb9f150, dated Jul. 7, 2020.

Product listing for 2" Deep Dish Olympic Weight Plates, from <https://yorkbarbell.com/product/deep-dish-olympic-plate>, accessed Nov. 22, 2021.

Product listing for Apollo Athletics Deep Dish Olympic Plates, from https://www.showmeweights.com/apollo-athletics-deep-dish-olympic-plates.html, accessed Nov. 30, 2021.

Product listing for Rogue Dumbbell Bumpers, From: http://web.archive.org/web/20180830044526/https:/www.roguefitness.com/rogue-dumbbell-bumpers, dated Aug. 30, 2018, accessed Nov. 22, 2021.

(56) References Cited

OTHER PUBLICATIONS

Product listing for Rogue LB Competition Plates, From: http://web.archive.org/web/20180724000915/https:/www.roguefitness.com/rogue-competition-plates, dated Jul. 24, 2018, accessed Nov. 22, 2021.
Product listing for Rogue Olympic Plates, from: http://web.archive.org/web/20190402011443/https://www.roguefitness.com/rogue-olympic-plates, dated Apr. 2, 2019, accessed Nov. 22, 2021.
Viavito Tri Grip Vinyl Standard Weight Plates: Published Mar. 17, 2016 [online], site visited Nov. 22, 2021. Available from Internet URL: https://www.amazon.co.uk/dp/B01D3U5RXI/ref=cm_sw_r_tw_dp_U x_epf5Db1B78TVQ (Year: 2016).
Written Opinion dated May 24, 2019 of International application No. PCT/US2019/015813.
York Barbell Weight Plates & Sets, from https://yorkbarbell.com/product-category/weight-plates/page/2/, dated Nov. 30, 2021.

* cited by examiner

MODIFIED WEIGHT TRAINING EQUIPMENT

CROSS-REFERENCE TO RELATED PATENT APPLICATIONS

This application is a divisional of U.S. patent application Ser. No. 15/885,292, filed Jan. 31, 2018, which is hereby incorporated by reference in its entirety for all purposes.

BACKGROUND

1. Field

The following description relates to modified weight training equipment. For example, weight training equipment may include one or more shock absorber regions for increasing shock absorption and reducing noise during use.

2. Description of Related Art

One drawback of the prior art weight training equipment, including bumper plate design, is that there is a tradeoff between the noise made when the weights are dropped on a floor and the amount of bounce the weights show after they hit the floor. Low durometer elastomers (e.g. 70) used in such equipment are relatively quiet, but they have a high bounce which can lead to injury. High durometer elastomers (e.g. 90) have a low bounce, but can make a very loud noise (over 130 dB) when dropped. Another drawback is that high durometer weights cause damage to the floor upon impact, especially in a training facility where tremendous force is exerted in small areas of the floor, causing cracks that necessitate frequent and costly repairs. Thus, there is a need for a weight design that has both low bounce and low noise when dropped, and is more gentle on the surface receiving the impact.

SUMMARY

This summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In an aspect, a weight object configured to be lifted from a ground surface includes a first portion made of high-durometer material, a second portion made of elastomeric material having lower durometer than the first portion, and a handle for holding the weight object and lifting the object from the ground surface, where the second portion includes spaced holes within the elastomeric material for absorbing noise generated when the weight object is dropped on the ground surface.

The second portion may be an outer portion of the weight object that comes into contact with the ground surface.

The second portion may be an inner portion of the weight object that does not come into contact with the ground surface.

The handle may include a handgrip.

The first and second portions may together be shaped as a bumper plate and the handle may include a bar passing through an opening in the plate.

At least one of the spaced holes may pass completely through the elastomeric material.

At least one of the spaced holes may pass partially through the elastomeric material.

Several of the spaced holes may pass partially through the elastomeric material of which adjacent spaced holes open in opposite directions.

The second portion may be shaped as a ring and the spaced holes may be evenly spaced around the ring.

A shape of the spaced holes may be at least one of hexagonal, circular, square, triangular, and trapezoidal.

The first and second portions together may be shaped as a bumper plate, and the second portion may be on the outer side of the bumper plate enveloping the first portion.

In another aspect, a weight object shaped as a bumper plate configured to be lifted from a ground surface includes at least one elastomeric material including spaced holes therein for absorbing noise generated when the weight object is dropped on the ground surface, and an opening configured to receive a handle for lifting the weight object.

The at least one elastomeric material may include at least two elastomeric materials each having spaced holes therein for absorbing noise.

The at least one elastomeric material may have at least two rows of spaced holes for absorbing noise.

The at least one elastomeric material may have spaced holes therein is positioned on the periphery of the bumper plate, which periphery makes contact with the ground surface when the object is dropped.

The at least one elastomeric material may include at least two elastomeric materials each having a different durometer.

A shape of the spaced holes may be at least one of hexagonal, circular, square, triangular, and trapezoidal.

At least one of the spaced holes may pass completely through the elastomeric material.

At least one of the spaced holes may pass partially through the elastomeric material.

The weight object may further include a handle inserted in the opening for holding the weight object and lifting the object from the ground surface.

Several of the spaced holes may pass partially through the elastomeric material of which spaced holes open in opposite directions.

The weight object may include a contact surface coming in contact with the ground surface when the object is dropped or is rested, and when the object is rested at least one hole in the at least one elastomeric material may extend parallel to the ground surface.

The weight object may include a contact surface coming in contact with the ground surface when the object is dropped or is rested, and when the object is rested at least one hole in the at least one elastomeric material may extend perpendicular to the ground surface.

In yet another aspect, a weight object shaped as a bumper plate and configured to be lifted from a ground surface includes a first portion positioned in a center of the bumper plate and made of elastomeric material, a second portion positioned on a periphery of the bumper plate and made of elastomeric material, where a periphery of the first portion includes a shaped groove formed circumferentially around the periphery, and the second portion is molded into the first portion with a projection shaped to match the shaped groove in the first portion, and at least one of the first and second portions comprises spaced holes within the elastomeric material for absorbing noise generated when the weight object is dropped on the ground surface.

The shaped groove in the first portion and the corresponding projection of the second portion may be T-shaped.

At least one of the spaced holes may pass completely through the elastomeric material.

At least one of the spaced holes may pass partially through the elastomeric material.

Several of the spaced holes may pass partially through the elastomeric material, of which adjacent spaced holes open in opposite directions.

The first and second portions may include different durometer elastomeric materials.

BRIEF DESCRIPTION OF THE DRAWINGS

The foregoing summary, as well as the following detailed description, will be better understood when read in conjunction with the appended drawings. For the purpose of illustration, certain examples of the present description are shown in the drawings. It should be understood, however, that the invention is not limited to the precise arrangements and instrumentalities shown. The accompanying drawings, which are incorporated in and constitute a part of this specification, illustrate an implementation of systems, apparatuses, and methods consistent with the present description and, together with the description, serve to explain advantages and principles consistent with the invention.

The relative size and depiction of individual elements, features and structures may be exaggerated for clarity, illustration, and convenience.

DETAILED DESCRIPTION

The following detailed description is provided to assist the reader in gaining a comprehensive understanding of the methods, apparatuses, and/or systems described herein. Accordingly, various changes, modifications, and equivalents of the systems, apparatuses and/or methods described herein will be suggested and thus apparent to those of ordinary skill in the art. Also, descriptions of well-known functions and constructions may be omitted for increased clarity and conciseness.

In addition, it is to be understood that the phraseology and terminology employed herein are for the purpose of description and should not be regarded as limiting. For example, the use of a singular term, such as, "a" is not intended as limiting of the number of items. Also the use of relational terms, such as but not limited to, "top," "bottom," "left," "right," "upper," "lower," "down," "up," "side," are used in the description for clarity and are not intended to limit the scope of the invention or the appended claims. Further, it should be understood that any one of the features can be used separately or in combination with other features. Other systems, methods, features, and advantages of the invention will be or become apparent to one with skill in the art upon examination of the detailed description. It is intended that such additional systems, methods, features, and advantages be included within this description, be within the scope of the present invention, and be protected by the accompanying claims.

As used herein, the term "about" means plus or minus 10% of a given value unless specifically indicated otherwise. As used herein, the term "shaped" means that an item has the overall appearance of a given shape even if there are minor variations from the pure form of said given shape. A pass through hole or a hole that passes completely through, is one that provides an opening in a solid body through which something, such as air, can pass. A pass through hole opens on opposite sides of the solid body or surface. A hole that passes partially through opens only on one side of the solid body or surface. A "groove" is a cut or depression on a material surface that is not surrounded by the material. A "layer" is a sheet, quantity or thickness of material forming a solid body or surface. In this disclosure, the term "quiet" will also be used to designate modified weights (i.e., bumper plates, dumbbells, kettlebells, etc) in accordance with different examples of the present invention that tend to exhibit low noise upon impact.

Figure 1:
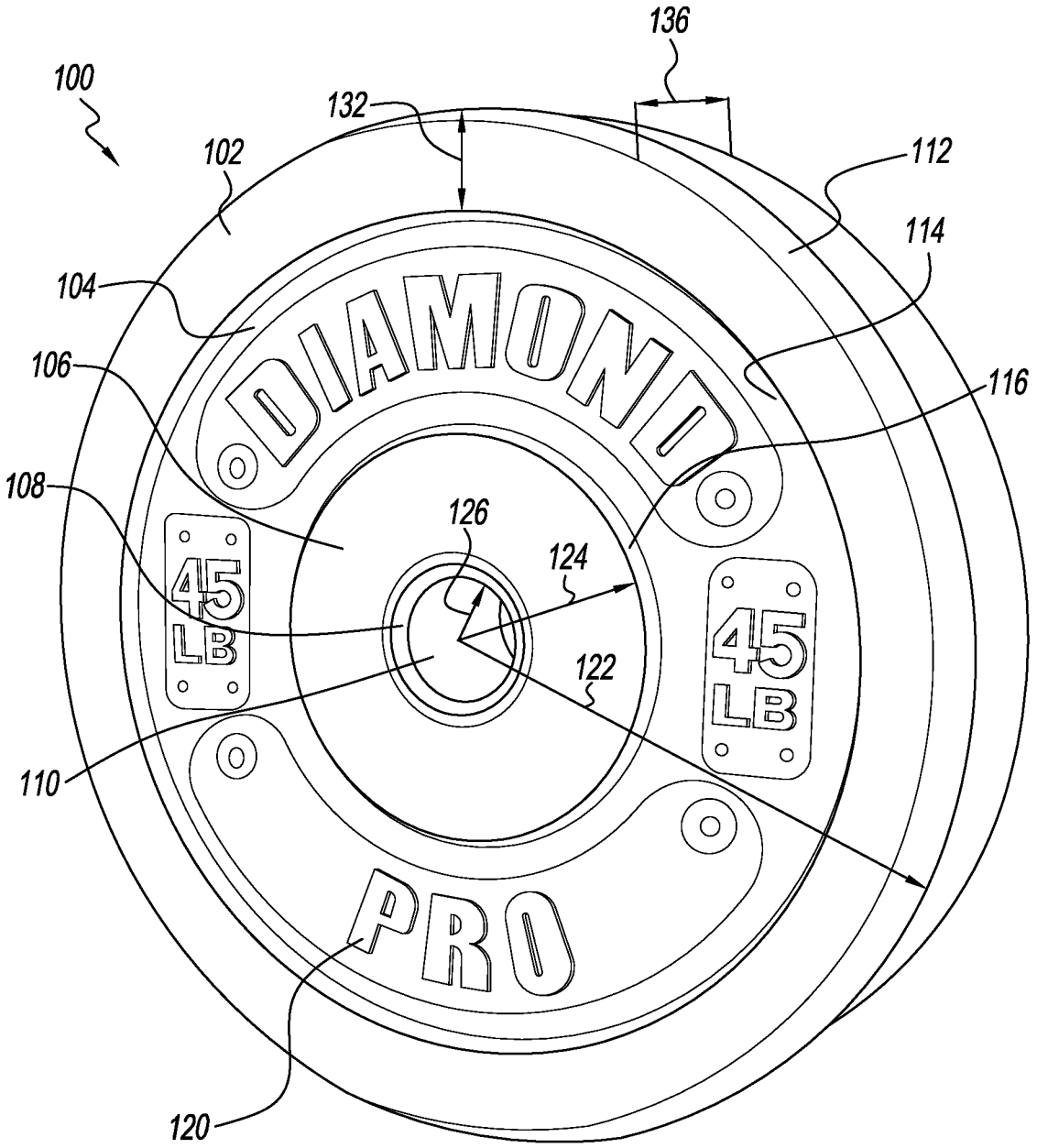
FIG. 1 PRIOR ART
FIG. 1 is a diagram illustrating a front perspective view of a conventional bumper plate.

FIG. 1 is a front perspective view of a prior art bumper plate 100. A bumper plate is a disk shaped weight that is mounted on a bar bell for weight training. The bumper plate includes an outer rim 102, body 104, hub 106 and collar 108. The collar describes a central bar hole 110. The interface between the rim and body includes an undercut 114. Thus the thickness of the body may be somewhat less than the thickness of the rim. The interface between the body and the hub includes a step 116. Thus the hub may have a larger thickness than the body. The larger thicknesses of the rim and hub relative to the body allow for raised indicia 120 to be molded into the body. The hub and rim protect said indicia when the bumper plate lies flat on the ground. The undercut also acts as a handle to make it easier to lift the bumper plate. The outer edge of the rim includes a bevel 112. This makes it easier to pick up the bumper plate when it is lying flat on the ground.

A typical bumper plate may have a radius 122 in the range of 8.75 inches to 8.86 inches (222.25 mm to 225.044 mm). Radius of 8.86 inches (222.25 mm) is a standard size for competition. The bar hole radius 126 is about 1 inch (25.4 mm). The hub radius 124 is about 4.26 inches (108.204 mm). The rim height 132 is about 1.77 inches (44.958 mm). The undercut is about 0.43 inches (10.922 mm). The rim thickness 136 may be in the range of 1.4 inches to 3.75 inches (35.56 mm to 95.25 mm) depending upon the weight of the bumper plate.

The bumper plate may be made of solid rubber, bonded crumb rubber, polyurethane or other elastomer. The durometer of the elastomer may be in the range of 70 to 90. The collar may be made of metal. The hub may include a metal disk plate for extra weight.

Figure 2:
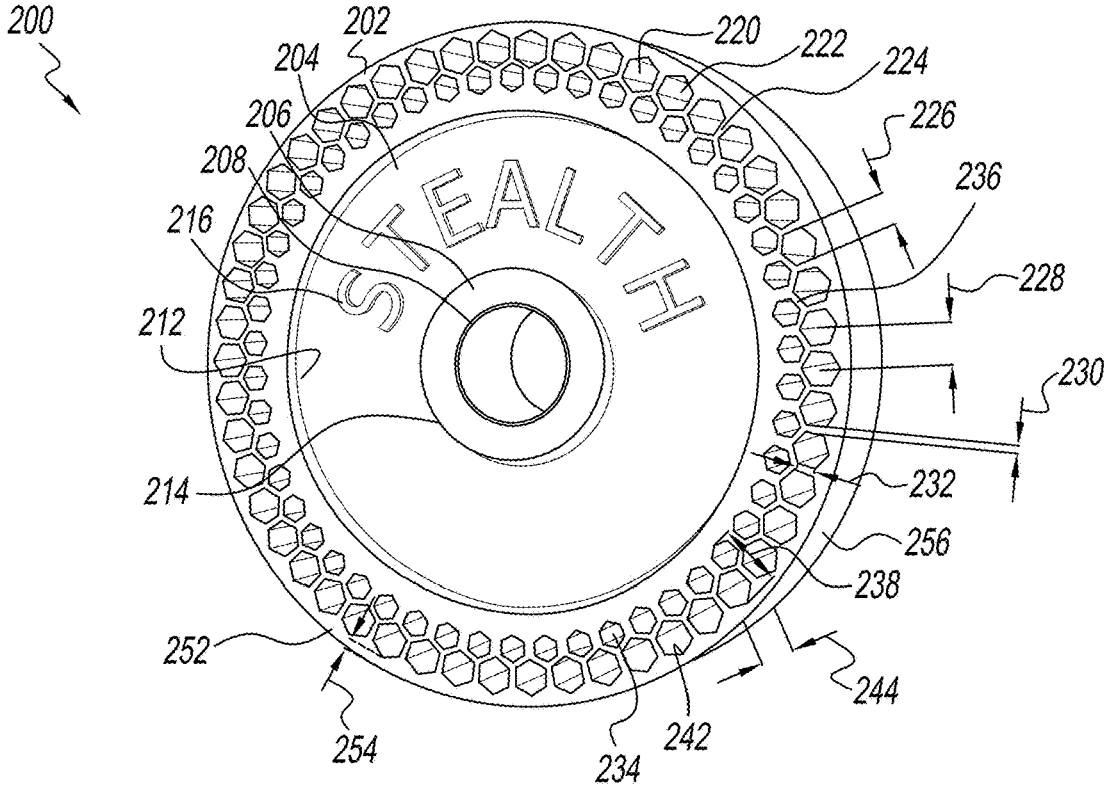
FIG. 2 is a diagram illustrating a front perspective view of an example of a quiet bumper plate.

FIG. 2 is a front perspective view of a modified bumper plate 200 in one example of the present invention. The bumper plate in FIG. 2 is disk shaped with a shock absorber region 220 in the rim 202. The shock absorber region 220 includes a first circumferential row of first holes 222. In one example, the holes 222 pass transversely through the rim and are evenly spaced. In a different example, the holes 222 do not pass completely through the rim but go through only partially. The holes 222 in this example are hexagonal, but any shape may be used. Some shapes which may be used for the hole include, but are not limited to, circle, square, triangle, trapezoidal among any other shapes including irregular shapes. In this example, the internal corners of the hexagons are rounded to reduce material cracking. A suitable internal radius of curvature of the internal corners 242 is in the range of 0.02 inches to 0.05 inches (0.05 mm to 1.27 mm). The elastomeric material between the holes 222 forms radial walls 224. The holes 222 and surrounding radial walls 224 act as shock absorbers when the bumper plate is dropped on the ground thus reducing the noise emitted without unduly increasing bounce. For bumper plates with a radius of about 8.75 inches (222.25 mm) or greater, a suitable first hole width 226 is in the range of 0.5 inches to 0.75 inches (12.7 mm to 19.05 mm). A suitable hole spacing 228 is in the range of 0.75 inches to 1.5 inches (19.05 mm to 38.1 mm). A suitable wall width 230 is in the range of 0.13 inches to 0.5 inches (3.301 mm to 12.7 mm). A suitable wall height 232 is in the range of 0.5 inches to 1 inch (12.7 mm to 25.4 mm). A suitable spacing for other shapes can vary and be experimentally determined as discussed below.

In accordance with the example illustrated in FIG. 2, a second circumferential row of second holes 234 may be provided adjacent to the row of first holes. As illustrated, the second holes 234 pass transversely through the disk, although in a different example may penetrate only partially. The second holes 234 form a plurality of circumferential walls 236 with the first holes 222. The second row of holes 234 and respective walls provide additional shock absorbing capability.

Additional rows of holes may be provided, as desired. The holes 222, 234 do not have to be the same shape or size within a given row. A suitable overall height of the shock absorber 238 region taken up by the rows of holes 222, 234 may be in the range of 0.5 inches to 1.5 inches (12.7 mm to 38.1 mm) for standard size equipment or vary in range for alternative designs.

Sufficient clearance 254 should be provided between the first holes 222 and the outer radial surface of the disk 256 to form a skin 252. A suitable skin thickness is typically in the range of 0.06 inches to 0.25 inches (1.524 mm to 6.35 mm). Larger thicknesses can be used for stronger skins depending on the selected material. The outer radial surface may also include radial projections (not shown) that can act as additional shock absorbers. For example, the shock absorber region 238 may be positioned on the outermost 2.5 inches to 3 inches (63.5 mm to 76.2 mm).

The quiet bumper plate may include a rim 202, body 204, hub 206 and collar 208. An undercut 212 may be provided at the interface of the rim and body. A step 214 may be provided at the interface of the body and hub. The dimensions of the rim, body, hub, collar, undercut and step may be similar to the dimensions of the corresponding features of the prior art bumper plate of FIG. 1. The undercut and step recess the body relative to the rim and hub so that raised indicia 216 may be provided in the body. A bevel (not shown) may also be provided on the outer corner of the rim. As noted, the outer dimensions of the plate preferably are similar to those of standard equipment but can vary in different settings.

In order to keep the same plate radius and weight as the prior art and/or standard for competition, the thickness 244 of the plate a may be increased to account for the loss of material from the holes 222, 234. Higher density materials may be also be added in different examples. An example is the use of metal plates provided at the hub or internal to the bumper plate to increase overall density without unduly increasing thickness.

The quiet bumper plate may be made of an elastomer, such as rubber, pressed crumb rubber, poly urethane or mixtures thereof. Durometers may be in the range of 60 to 90. Lower durometer elastomers may be used in bumper plates designated for home use. This will help keep the noise to levels acceptable in homes. A different durometer may be used in the shock absorber region relative to the rest of the quiet bumper plate.

Figure 3:
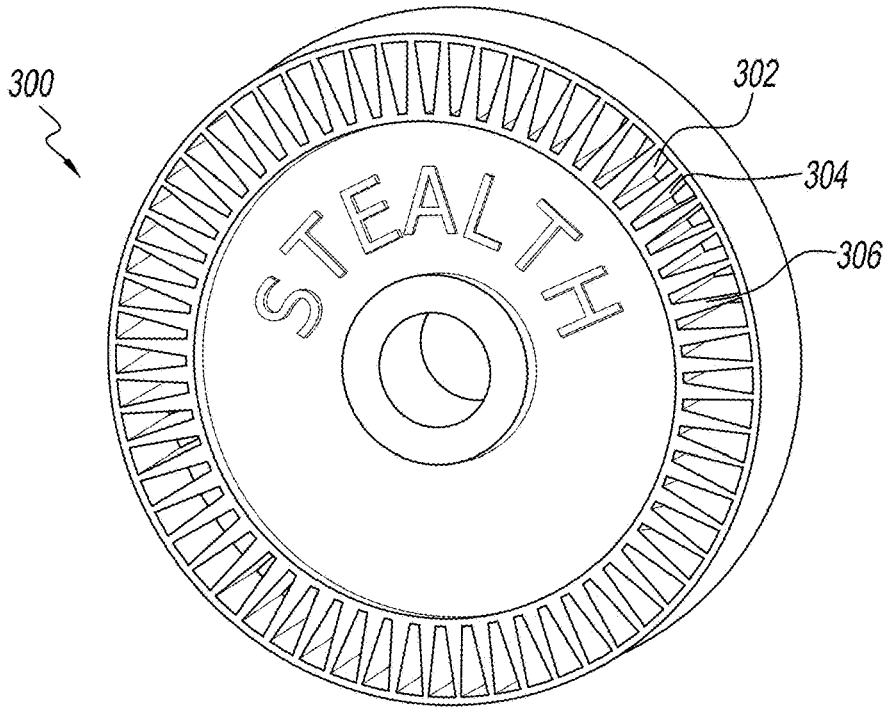
FIG. 3 is a diagram illustrating a front perspective view of another example of a quiet bumper plate.

FIG. 3 is a front perspective view of an alternative quiet bumper plate 300. This is similar to the quiet bumper plate of FIG. 2 except the shock absorber region 302 includes first holes 304 with an elongated inverted trapezoidal shape. The first holes 304 are evenly spaced circumferentially. Radial walls 306 are formed between the holes 304. The radial walls 306 have a relatively wide base and narrow top.

Figure 4:
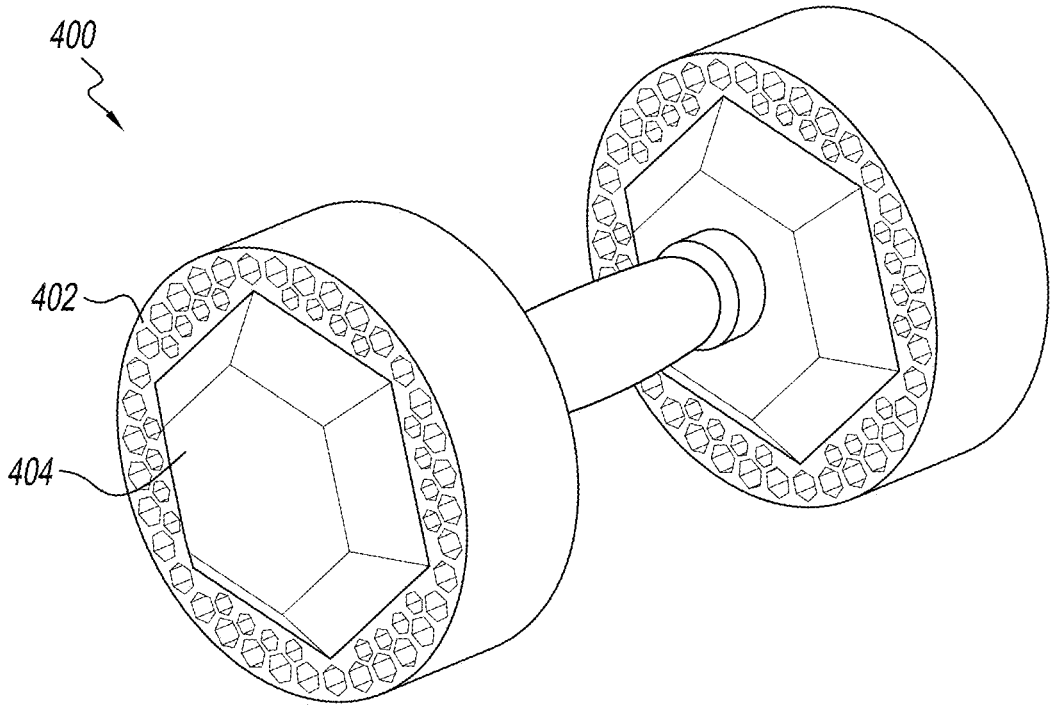
FIG. 4 is a diagram illustrating a side perspective view of an example of a quiet dumbbell.

FIG. 4 is a side perspective view of a quiet dumbbell 400. The dumbbell includes a conventional hexagonal weight dumbbell 404 with a shock absorber 402 provided around each weight. The dumbbell 404 may be made of metal and the shock absorber 402 may be made of an elastomer. The holes in the shock absorber are similar to the holes in the quiet bumper plate of FIG. 2, or may be adjusted to comport with the overall dimensions of the dumbbell.

Figure 5:
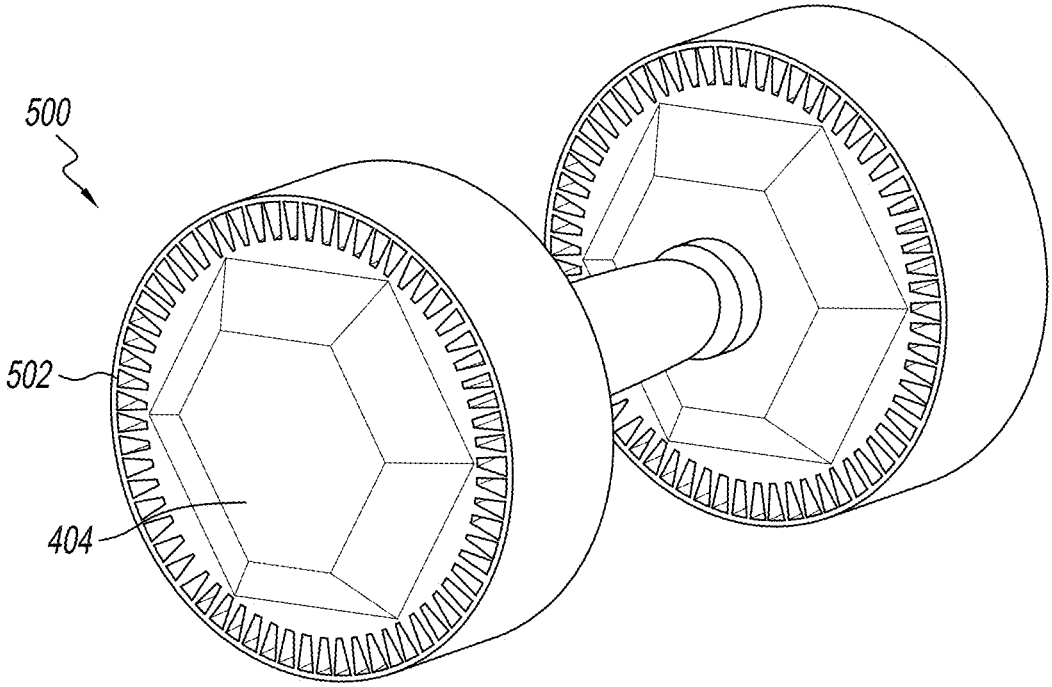
FIG. 5 is a diagram illustrating a side perspective view of another example of a quiet dumbbell.

FIG. 5 is a side perspective view of an alternative quiet dumbbell 500. The dumbbell includes a conventional hexagonal weight dumbbell 404 with a shock absorber 502 provided around each weight. The dumbbell 404 may be made of metal and the shock absorber 502 may be made of an elastomer. The holes in the shock absorber are similar to the holes in the quiet bumper plate of FIG. 3, or may be adjusted to comport with the dimensions of the dumbbell. The shock absorbers for either quiet dumbbell (FIG. 4 or FIG. 5) may have one or more flat outer surfaces for storage and stacking (not shown). In a specific example, the shock absorbing elastomeric layer can be configured so that the weight can retain the shape of a conventional hexagonal weight dumbbell.

Figure 6:
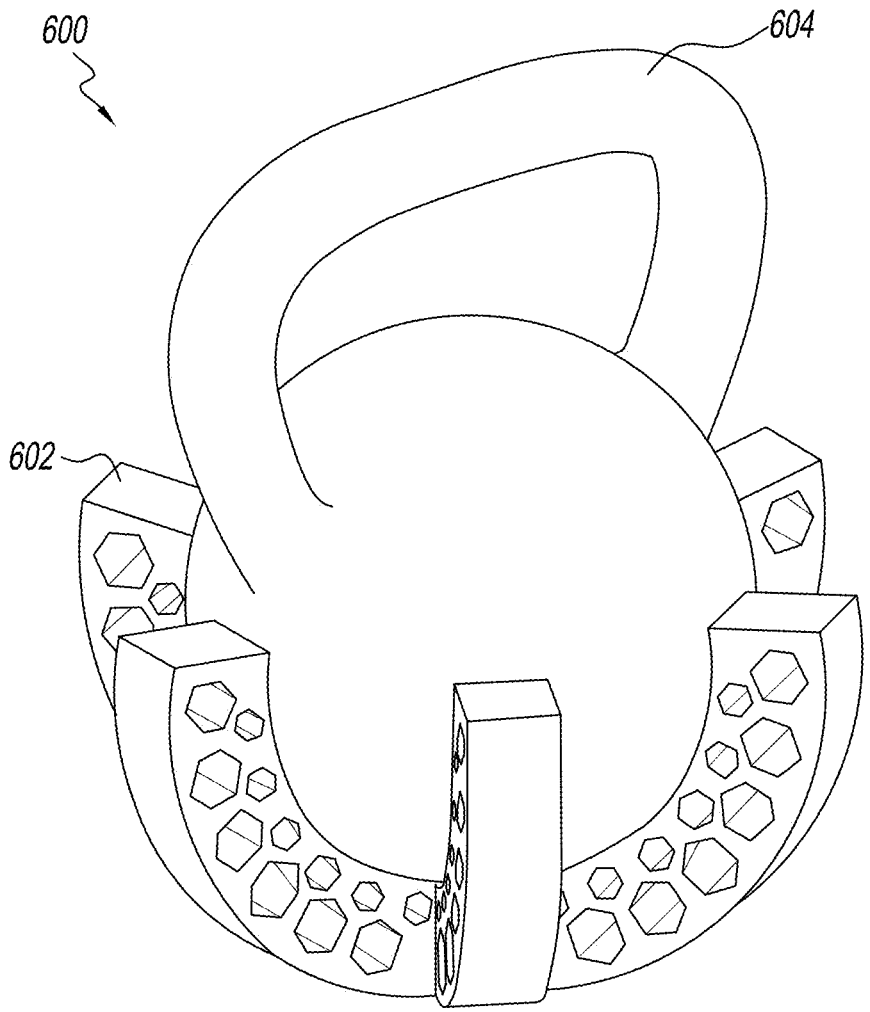
FIG. 6 is a diagram illustrating a side perspective view of an example of a quiet kettlebell.

FIG. 6 is a side perspective view of a modified kettlebell 600. The kettlebell 600 includes a conventional kettlebell 604 with several shock absorber crescents 602 provided around the weight. The kettlebell 600 may be made of metal and the shock absorber crescents may be made of an elastomer. The holes in the shock absorber crescents are similar to the holes in the quiet bumper plate of FIG. 2 or modified as necessary to correspond to the dimensions of the kettlebell. The crescents may be attached to the kettlebell by any known means, such as welding, gluing, pre-molding or other means. Six to eight crescents are provided radially and join at the bottom of the kettlebell. Sufficient number of crescents are applied so that the metal kettlebell within the crescents does not hit the ground when dropped.

Figure 7:
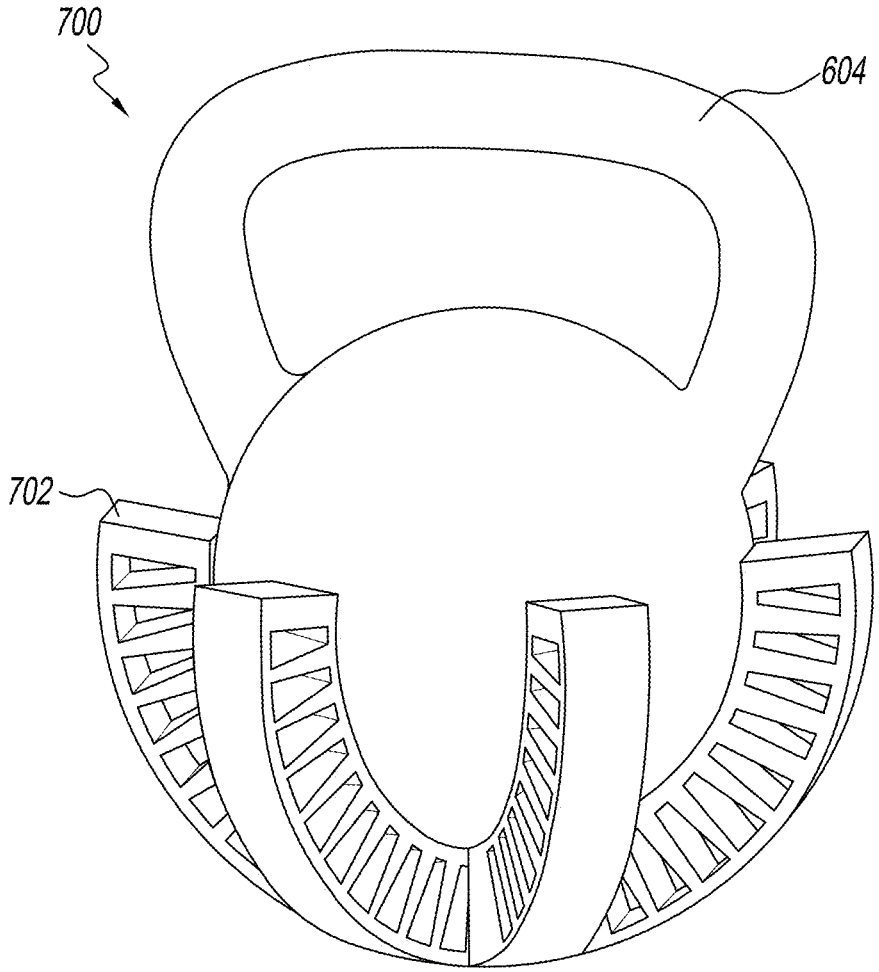
FIG. 7 is a diagram illustrating a front perspective view of another example of a quiet kettlebell.

FIG. 7 is a front perspective view of an alternative modified kettlebell 700. The kettlebell includes a conventional kettlebell 604 with several shock absorber crescents 702 provided around the weight. The kettlebell 604 may be made of metal and the shock absorber crescents 702 may be made of an elastomer. The holes in the shock absorber crescents are similar to the holes in the quiet bumper plate of FIG. 3 or adjusted to the dimensions of the device. The crescents may be attached to the kettlebell by any known means, such as welding, gluing, or pre-molding. In this example, six to eight crescents are provided radially and join at the bottom of the kettlebell though more or less crescents may be used. As in other examples discussed herein, the holes may extend through only partially through the shock absorber crescents. Alternative designs for a quiet kettlebell that does not use absorber crescents may include a heavy inner portion and an elastomeric outer portion provided with shock absorbing holes of different dimensions and arrangements. In such embodiments, the holes can be formed extending radially toward the center of the kettlebell or at an angle. In alternative embodiments to those illustrated in FIGS. 6 and 7, the ends of crescents 602 and 702 facing the top of the kettlebell may gradually taper to avoid sharp edges (not shown). In yet another embodiment, instead of crescents, the shock absorbing portion of the kettlebell can be configured as a layer of elastomeric material with holes therein that envelops the metal core of the kettlebell.

Figure 8:
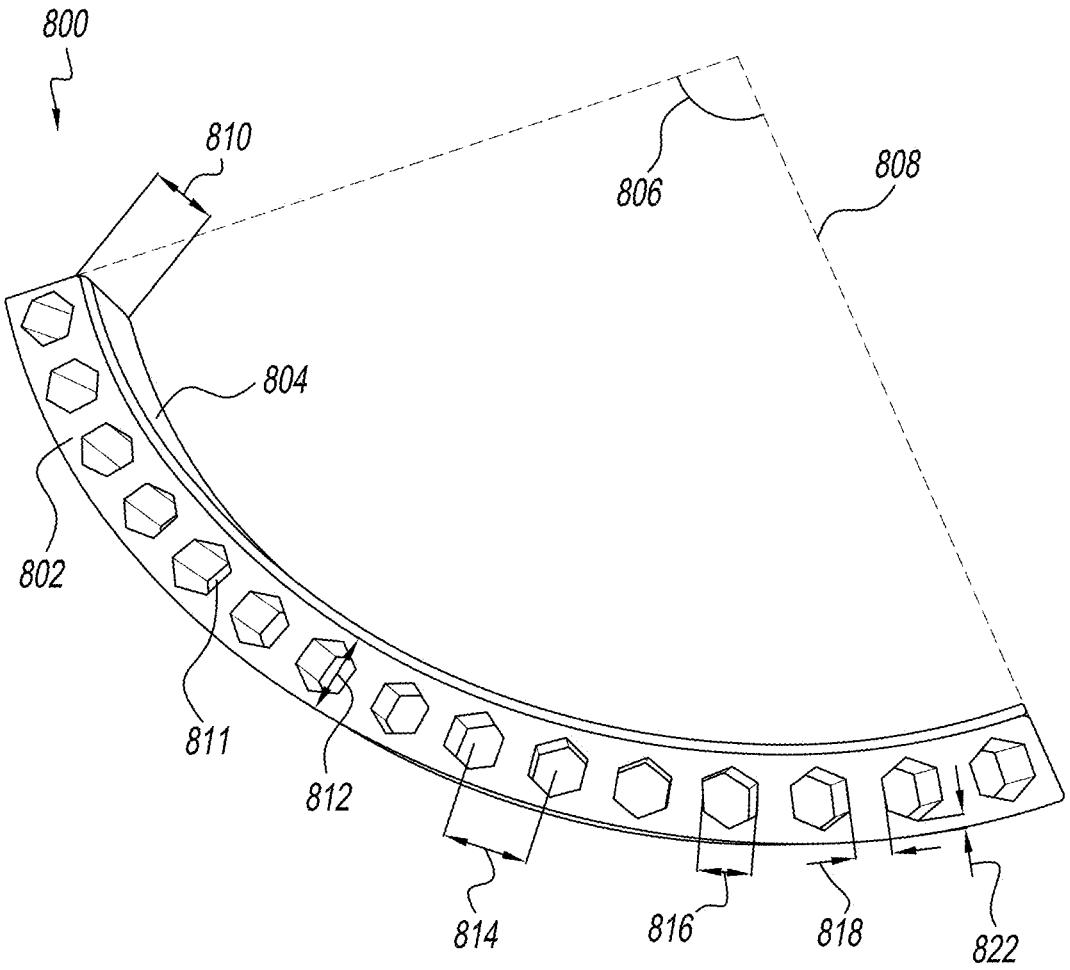
FIG. 8 is a diagram illustrating a side perspective view of a crescent shock absorber.

FIG. 8 is a side perspective view of a crescent shock absorber 800 made according to the current invention. The crescent has a thickness 810 of about 1 inch (25.4 mm). It has a height 812 of about 1 inch. It has an arcuate shape with a crescent angle 806 of about 90°. The radius of curvature to the inside surface 808 is about 8.75 inches (222.25 mm). Thus, the crescent would conform to the outer curvature of the prior art bumper plate of FIG. 1. A single row of evenly spaced hexagonal first holes 811 is provided. The hole spacing 814, in one example, may be about 1 inch (25.4 mm). The hole width 816 is about 0.63 inches (16.002 mm). The radial walls between the holes each have a width 818 of about 0.38 inches (9.652 mm). The skin thickness 822 is about 0.13 inches (3.302 mm). A first half of a reclosable 3M™ DualLock™ fastener 804 is provided on the inside surface of the crescent in a specific implementation. The first half was mated to the corresponding second half of the DualLock fastener that was bonded to the outer radial surface of a conventional bumper plate similar to the one shown in FIG. 1. The crescent was formed by molding a thermoplastic elastomeric compound, Stantoprene™ 101-64 (item 802). The rated durometer of the Stantoprene was Shore A 69.

In an example, a test was conducted with a conventional barbell weighing 135 lb. The barbell had a bumper plate on each end of the style shown in FIG. 1. The barbell was dropped from a height of 4'10 inches (147.32 cm) onto a rubber stall mat covering a poured concrete floor. The noise of the impact was measured with a decibel meter. 136 dB was recorded when the barbell was dropped without any crescent shock absorbers on the bumper plates.

Another test was conducted with four crescent shock absorbers attached to the outer radial surfaces of the bumper plates on the barbell using the DualLock fasteners. The crescents wrapped around the outer surface of each bumper plate. The drop test was repeated. The noise recorded was only 95 dB with minor increase in bounce. It will be appreciated that the testing procedure described above can be used to help design modified weight training equipment with desired characteristics. For example, running the described tests on different hole designs can determine the hole configuration that is optimal for a desired noise level.

Figure 9:
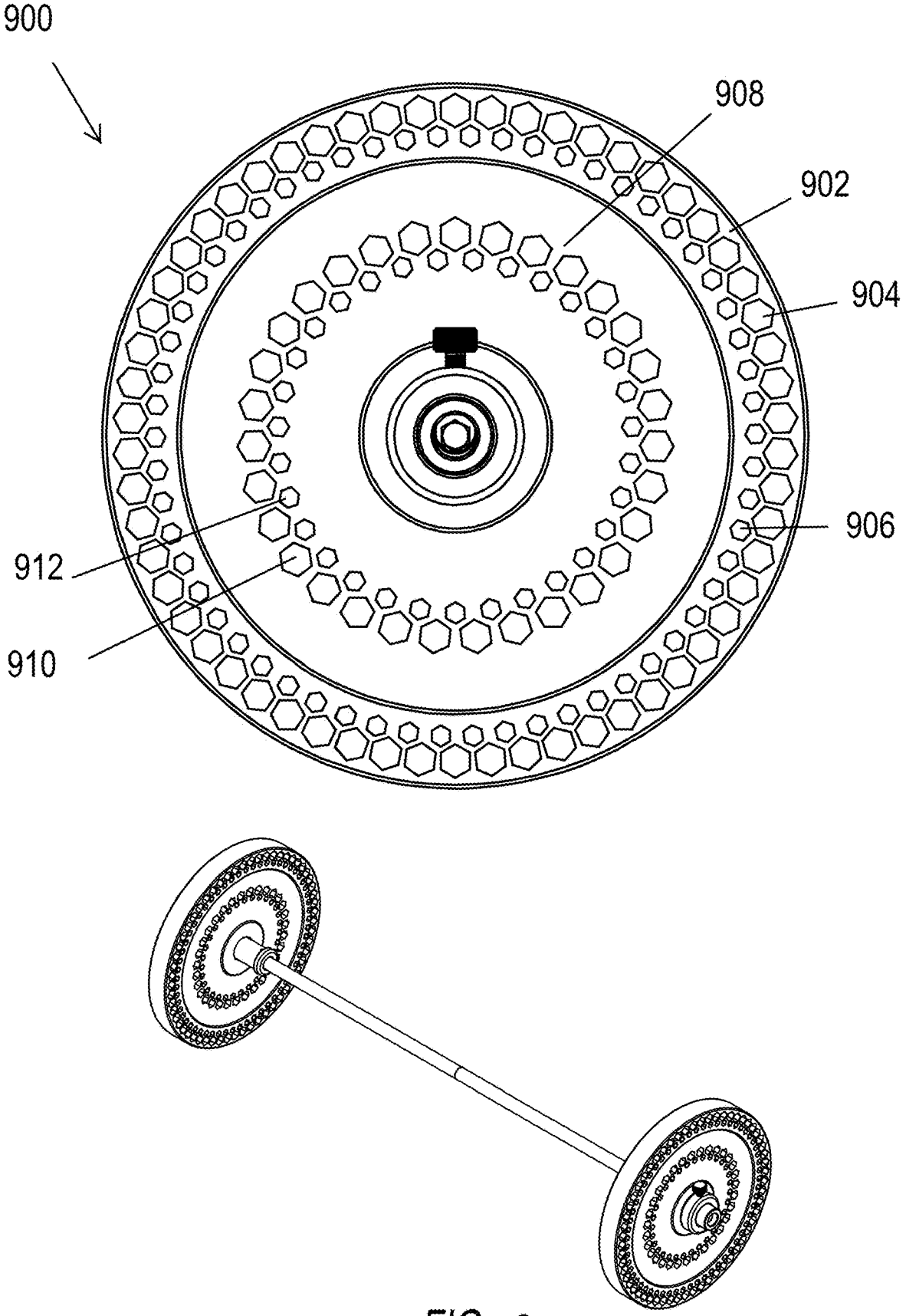
FIG. 9 is a diagram illustrating a front view of yet another example of a quiet bumper plate and a perspective view of a barbell with two quiet bumper plates.

FIG. 9 is a diagram illustrating a front view of yet another example of a quiet bumper plate and a perspective view of a barbell with the quiet bumper plate.

Referring to FIG. 9, another example of a quiet bumper plate 900 is illustrated that is similar to the quiet bumper plate of FIG. 2 except there are at least two shock absorber regions 902, 908. The first region 902 includes a first circumferential row of holes 904 and possibly a second circumferential row of holes 906, and the second region 908 includes a third circumferential row of holes 910 and possibly a fourth circumferential row of holes 912.

In a preferred embodiment, the dimensions of the first circumferential row of holes 904 and the third circumferential row of holes 910 may be the same, and may have the same dimensions as described in reference to the first holes 222 of the quiet bumper plate 200 of FIG. 2. The dimensions of the optional second circumferential row of holes 906 and the fourth circumferential row of holes 912 may be the same, and may have the same dimensions as described in reference to the second holes 234 of the quiet bumper plate 200 of FIG. 2. Other dimensions including the internal radius of curvature of the internal corners of the holes 904, 906, 910, 912, hole spacing, wall width, wall height, overall height of each shock absorber region 902, 908 taken up by two rows of holes, and the skin thickness may be the same as the dimensions provided in the example of FIG. 2. In a preferred example, the distance between the outer rim of the bumper plate 900 and the outermost edge of the second shock absorber region 908 may be 5 inches to 7.5 inches (127 mm to 190.5 mm), where the outermost edge of the second shock absorber region 908 is defined by a circle contacting the point of each holes 910 which is closest to the outer rim of the bumper plate 900.

In this example, by moving the holes toward the center of the plate, vibration and force that is transmitted from the ground when the plate is dropped can be better controlled. By moving the holes toward the center, this allows the two solid sections of the plate to move somewhat independently from each other when a large force is applied such as when a barbell is dropped. The resulting reduction of force would reduce the stress on the flooring below, thus reducing overall noise as well as damage to flooring. The second shock absorber region 908 and corresponding holes 910, 912 would also reduce the forces put on the collar and exerted from the collar, thus reducing the likelihood of a failure point. As before, holes can go through for ease of manufacture or go partially through to provide higher structural integrity. In the case of partial pass-through holes, adjacent holes in a row may alternate in a pattern where every other hole faces (i.e. are open in) one direction, and the alternate adjacent holes face (i.e. are open in) the other direction. This hole arrangement may be applied to all embodiments described in this application (i.e., FIGS. 3-11), and is intended to improve the structural integrity of the shock absorbing portions of the respective weights.

Figure 10:
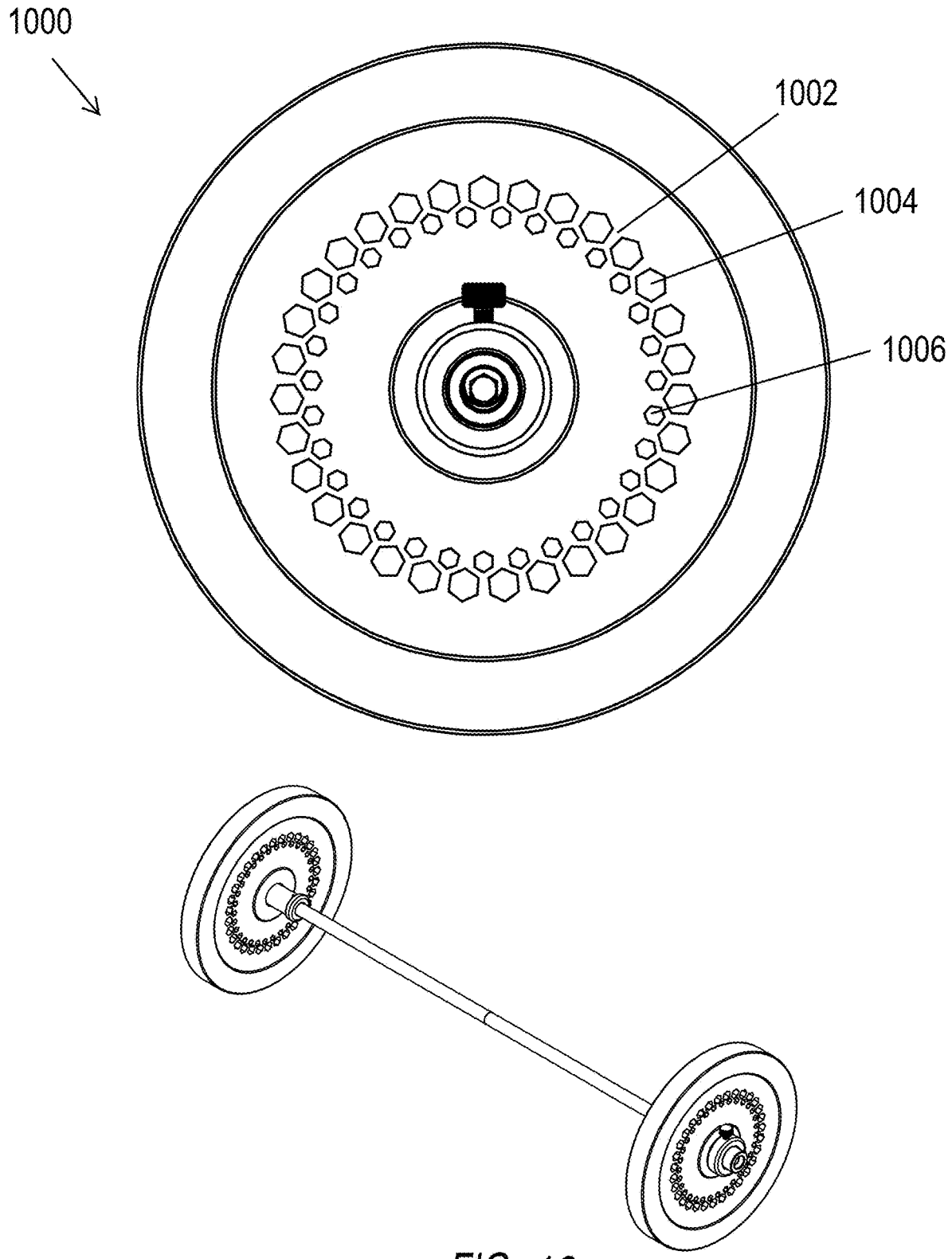
FIG. 10 is a diagram illustrating a front view of an additional example of a quiet bumper plate and a perspective view of a barbell with two quiet bumper plates.

FIG. 10 is a diagram illustrating a front view of an additional example of a quiet bumper plate and a perspective view of a barbell with the quiet bumper plate.

Referring to FIG. 10, another example of a quiet bumper plate 1000 is illustrated that is similar to the quiet bumper plate of FIG. 9 except there is only the inner shock absorber region 1002. This region 1002 includes a first circumferential row of holes 1004 and an optional second circumferential row of holes 1006.

In a preferred embodiment, the dimensions of the first circumferential row of holes 1004 may be the same as described in reference to the first holes 222 of the quiet bumper plate 200 of FIG. 2. The dimensions of the second circumferential row of holes 1006 may be the same as described in reference to the second holes 234 of the quiet bumper plate 200 of FIG. 2. Other dimensions including the internal radius of curvature of the internal corners of the holes 1004, 1006 hole spacing, wall width, wall height, overall height of the shock absorber region 1002 taken up by the two rows of holes, and the skin thickness may be the same as the dimensions provided in the example of FIG. 2, or vary as desired. In a preferred example, the distance between the outer rim of the bumper plate 1000 and the outermost edge of the shock absorber region 1002 may be 5 inches to 7.5 inches (127 mm to 190.5 mm), where the outermost edge of the shock absorber region 1002 is defined by a circle contacting the point of each holes 1004 which is closest to the outer rim of the bumper plate 1000.

Further, it should be appreciated that the sizes and dimensions of holes may vary according to optimal dimensions determined through testing. That is, testing procedure can be used to help design modified bumper plates, or more generally weights, with desired characteristics. For example, running the described tests on different hole designs can determine the hole configuration that is optimal for a desired noise level and/or weight equipment.

In this example, by moving the row of shock absorbing holes 1004, 1006 to the center of the plate, this may increase durability over variations where the shock absorbency is on the outer ring.

Figure 11:
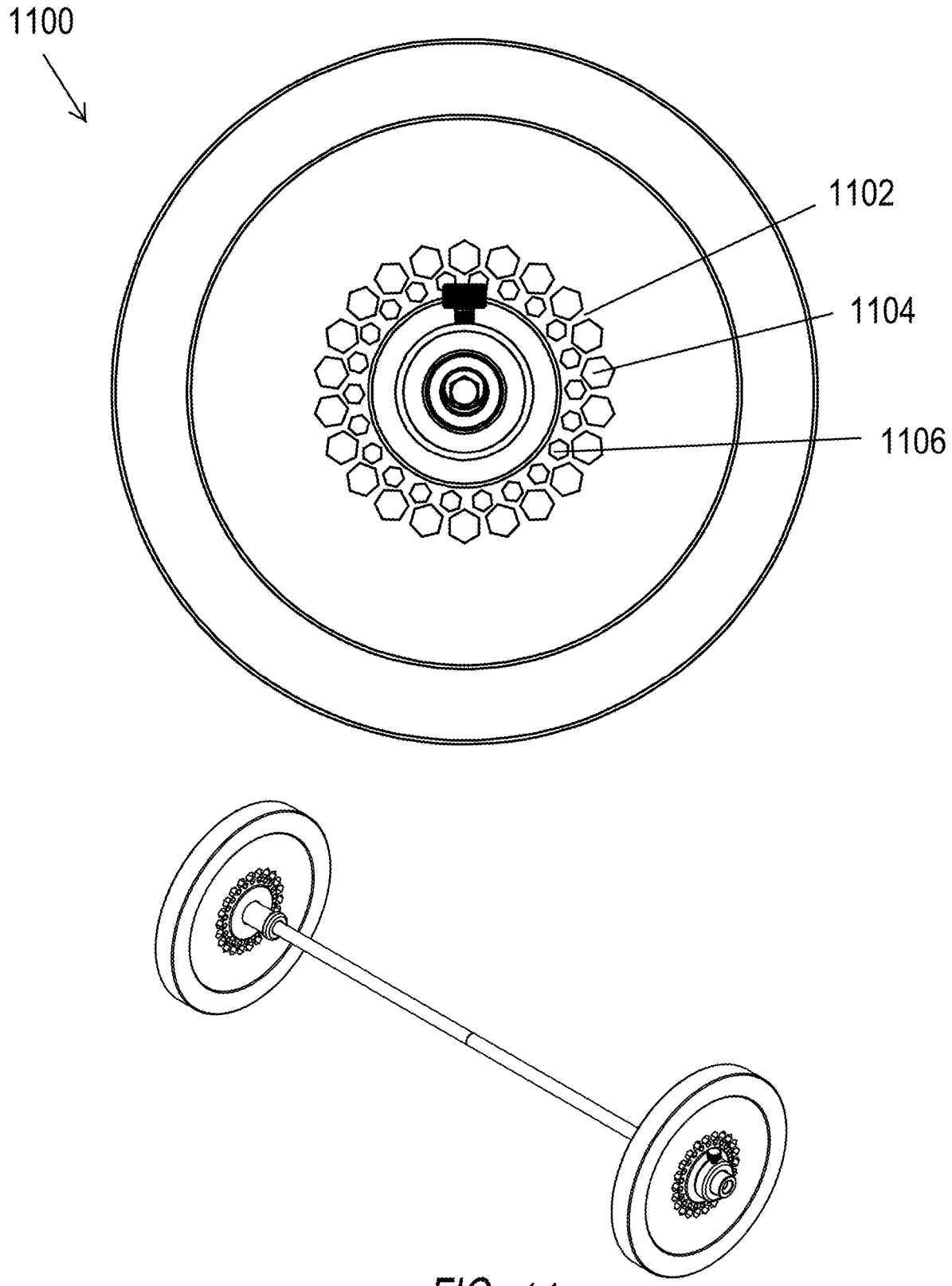
FIG. 11 is a diagram illustrating a front view of another additional example of a quiet bumper plate and a perspective view of a barbell with two quiet bumper plates.

FIG. 11 is a diagram illustrating a front view of another example of a quiet bumper plate and a perspective view of a barbell with the quiet bumper plate.

Referring to FIG. 11, another example of a quiet bumper plate 1100 is illustrated. This example is similar to the quiet bumper plate of FIG. 10 except the inner shock absorber region 1102 is closer to the collar of the bumper plate 1100. This region 1102 includes a first circumferential row of holes 1104 and an optional second circumferential row of holes 1106.

In a preferred embodiment, the dimensions of the first circumferential row of holes 1104 may be the same as described in reference to the first holes 222 of the quiet bumper plate 200 of FIG. 2, or may vary as desired or dictated by design. The dimensions of the second circumferential row of holes 1106 may be the same as described in reference to the second holes 234 of the quiet bumper plate 200 of FIG. 2. Other dimensions including the internal radius of curvature of the internal corners of the holes 1104, 1106 hole spacing, wall width, wall height, overall height of the shock absorber region 1102 taken up by the two rows of holes, and the skin thickness may be the same as the dimensions provided in the example of FIG. 2, or may vary as desired or dictated by design. In a preferred example, the distance between the outer rim of the bumper plate 1100 and the outermost edge of the shock absorber region 1102 may be 6 inches to 7.5 inches (152.4 mm to 190.5 mm), where the outermost edge of the shock absorber region 1102 is defined by a circle contacting the point of each holes 1104 which is closest to the outer rim of the bumper plate 1100.

In this example, by moving the row of shock absorbing holes 1104, 1106 to the collar of the plate, this may increase durability over variations where the shock absorbency is on the outer ring. By moving the row of shock absorbing holes 1104, 1106 to where the bar passes through the plate this could also reduce the forces that cause damage to the collar. It will be appreciated that the bar hole alone or in combination with the bar can be used as a handle to hold and lift the plate off the ground.

Figure 12:
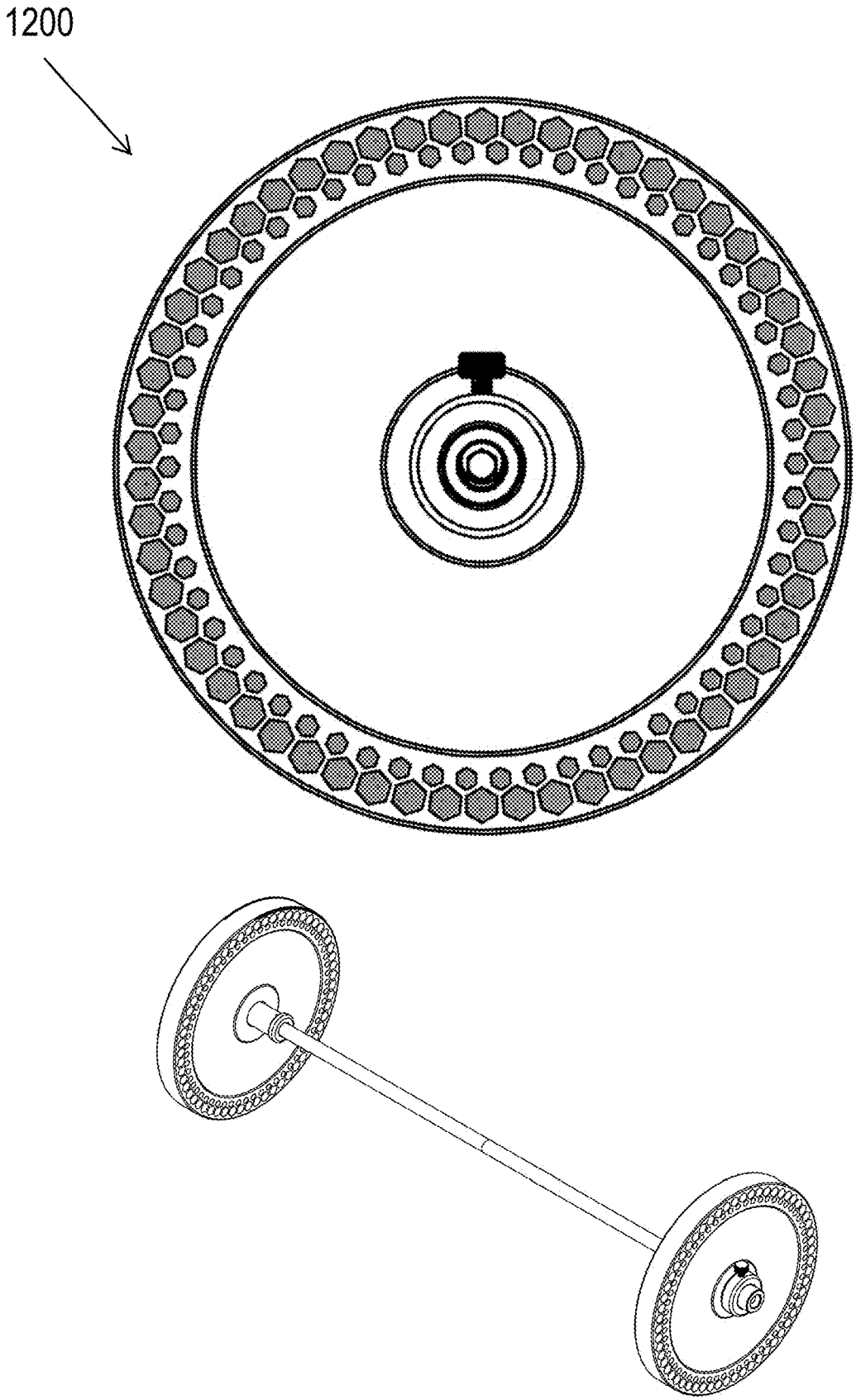
FIG. 12 is a diagram illustrating a front view of a further example of a quiet bumper plate and a perspective view of a barbell with two quiet bumper plates.

FIG. 12 is a diagram illustrating a front view of a further example of a quiet bumper plate 1200 and a perspective view of a barbell with the quiet bumper plate. The bumper plate 1200 of FIG. 12 is a variation of the bumper plate 200 illustrated in FIG. 2 in which a high-density foam is added to the open spaces of the shock absorbing holes on the outer ring. In this example, by adding the foam to the open spaces of the shock absorbing holes, all the benefits of the bumper plate 200 of FIG. 2 are retained with the added benefits of reduced noise reduction and compression and increased durability.

While this example illustrates foam being added to all holes, a number of different variations may be provided. For example, foam may be added to only the first row of circumferential holes and not the second row of circumferential holes. In contrast, the foam may be added to only the second row of circumferential holes and not the first row of circumferential holes. Further, foam may be added to only half of the holes in any type of arrangement such as every other hole or only on one side of the bumper plate 1200. This example may be applied to all embodiments illustrated; that is, foam may be used to fill holes in all embodiments described throughout the application. Other materials may also be used to fill the holes such as elastomeric, gel, or other materials.

In another aspect, flat sheets of elastomers with shock absorber regions may be used as protective mats. The shock absorber regions may be similar to the ones described above. Thus when a weight is dropped on the mat, the mat will suppress noise without unduly increasing bounce. The shock absorber mats may be made by extrusion.

Figure 13:
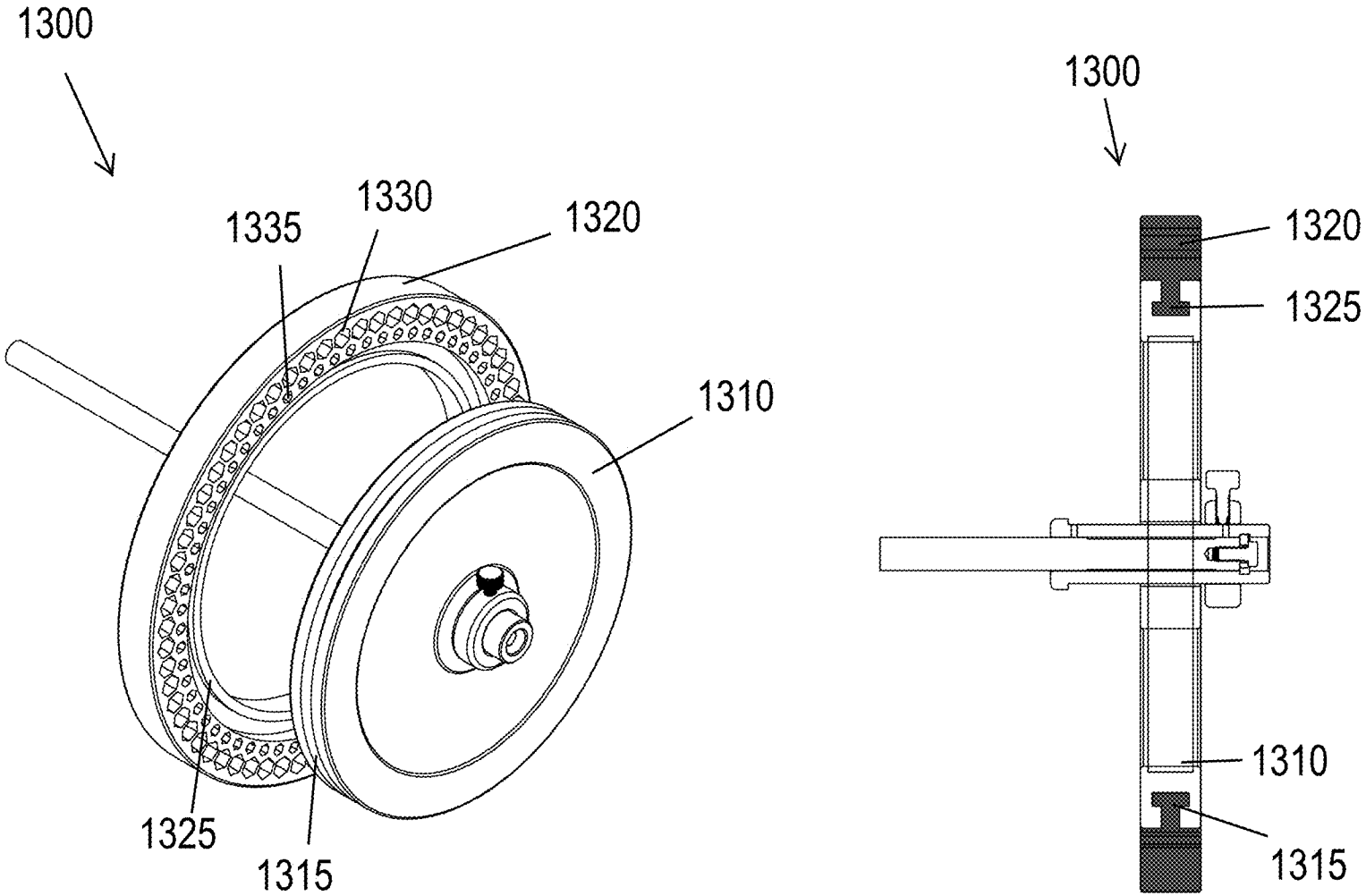
FIG. 13 is a diagram illustrating a quiet bumper plate formed by a two-part molding process of one or more materials.

FIG. 13 is a diagram illustrating a quiet bumper plate formed by a two-part molding process of one or more materials.

Referring to FIG. 13, a method of manufacturing a quiet bumper plate 1300 and a quiet bumper plate 1300 formed using such a method are described. According to this example, the center section 1310 of the plate 1300 may be molded to the outside ring 1320 in a two-part molding process. This manufacturing process would allow the center section 1310 of the plate 1300 to be molded in a higher density rubber allowing for reduced bounce and greater durability.

For example, the center section 1310 may be formed of rubber having a density in the range of 50 durometers to 70 durometers, preferably in the range of 55 durometers to 70 durometers, and most preferably in the range of 59 durometers to 69 durometers. The outside ring 1320 may be formed of rubber having a density in the range of 70 durometers to 90 durometers, preferably in the range of 75 durometers to 90 durometers, and most preferably in the range of 79 durometers to 89 durometers. Higher density or durometer bumper plates bounce less and are more durable than lower density plates. Accordingly, at least one advantage of a higher density outside ring 1320 includes providing a more durable and less bouncy bumper plate while maintaining the shock absorption advantages of a lower durometer center section 1310.

In another example, the center section 1310 may be formed of rubber having a higher density than the rubber forming the outside ring 1320. In other words, unlike the previous example, the lower density section may be formed on the outside while the higher density section is formed on the inside. In a further example, the center section 1310 and the outside ring 1320 may be formed of different density materials or different materials altogether including any one or more of a rubber, a polymer, a metal, other elastomers, or other materials.

In an example, a method of manufacturing the bumper plate 1300 includes molding the center section 1310 of the plate 1300 with an inverted T-shaped groove 1315 formed circumferentially around the entirety of the outer ring, as illustrated in the cross-sectional view of the bumper plate 1300. After the center section 1310 has cured or is partially cured, the outer section 1320 could be molded with a T-shaped projection 1325 formed circumferentially around the entirety of the outer section 1320 which corresponds to the T-shaped groove 1315 of the center section 1310. In this example, the outer section 1320 is also molded to include a first row of circumferential holes 1330 and a second row of circumferential holes 1335. This results in the bumper plate 1300 having the same arrangement of holes as provided in the bumper plate 200 of the example in FIG. 2 but the bumper plate 1300 being formed on one or more materials having different characteristics. While this example describes a T-shaped groove 1315 and a T-shaped projection 1325, it should be appreciated that a number of other shapes may be used for the groove and projection such as corresponding squares, triangles, U-shapes, among any other shapes. In addition, while this example describes the grooves and projections around the entire circumference of the bumper plate 1300, it should be appreciated that the grooves and projections may be formed around one or more partial sections around the bumper plate 1300.

Further, while this example results in the bumper plate 1300 having the same arrangement of holes as provided in the bumper plate 200 of the example in FIG. 2, it should be appreciated that any of the described and envisioned examples may also be formed according to this method. That is, the inner section may also be molded with holes to result in a bumper plate 900 as provided in the example in FIG. 9, or the inner section only may be molded with holes to result in a bumper plate 1000, 1010 as provided in the examples of FIGS. 10 and 11. In addition, in all of these examples, the resulting bumper plate 1300 may include holes that are filled with foam as described in connection with the description provided for FIG. 12.

Sound tests were conducted using an example prototype of the above described bumper plates as illustrated in FIG. 2.

The test parameters used were as follows:

Brands of Bumpers: Rogue Echo—88 Durometer Bumper Plates

System Weight: 95 lbs (2×45 lb bumpers, 1×5 lb wooden Dowel)

Barbell: Wooden Dowel 2"

Flooring: Standard ¾" Rubber Stall Mat On Concrete

Collars: Clout Fitness Collars dB Meter distance from barbell: 4

The results for this test are described below in Table 1. Referring to Table 1, the Rogue Echo results are dB values without use of the prototype, the Stealth 1 Stip SWL Prototype results are dB values with use of the prototype. Delta refers to the difference in values with and without use of the prototype, other values including percent decrease, average percent decrease, average dB decrease, and percent of noise eliminated are based on the calculated delta values.

TABLE 1

| | Rogue Echo | Stealth 1 Strip SWL Prototype | Delta | % Decrease | Avg % Decrease | Avg dB Decrease | % of Noise Elimination |
|---|---|---|---|---|---|---|---|
| 34" Waist | 97.1 | 84.4 | −12.7 | −13% | −11% | −10.9 | 90% |
| | 102.6 | 96.5 | −6.1 | −6% | | | |
| | 102.7 | 88.6 | −14.1 | −14% | | | |
| | | 82.8 | *not factored in | | | | |
| 56" | 97.8 | 91.0 | −6.8 | −7% | −15% | −14.7 | 90-99% |
| Shoulder | 103.3 | 85.4 | −17.9 | −17% | | | |
| Front | 98.4 | 84.0 | −14.4 | −15% | | | |
| Rack | 97.5 | 77.9 | −19.6 | −20% | | | |
| | 103.4 | *not factored in | | | | | |
| 79.5" | 110.6 | 95.2 | −15.4 | −14% | −13% | −14.7 | 90-99% |
| Overhead | 105.9 | 95.2 | −10.7 | −10% | | | |
| | 111.3 | 93.5 | −17.8 | −16% | | | |
| | 100.4 | 95.6 | −4.8 | −5% | | | |
| | 111.3 | 86.3 | −25.0 | −22% | | | |

One of skill in the art will recognize that the described examples are not limited to any particular equipment size. Further one of skill in the art will recognize that the bumper plates, dumbbells, kettlebells, and shock absorbers described herein are not limited to any type of material. As a non-limiting example, the bumper plates are formed primarily from rubber. One skilled in the art will recognize that other diameters, types and thicknesses of preferred materials can be utilized when taking into consideration preferred shock absorption characteristics and different applications that can be determined and optimized, for example, via sound testing as described above.

An additional configuration is envisioned as part of all embodiments discussed above. The modification is based on the "sealing" of the outward facing holes, similar to a familiar sealing of a honeycomb. The sealing may be achieved with a membrane that covers the outward facing openings, thus protecting them from dirt without affecting the overall design and/or efficiency of the holes. Methods for sealing the outward facing holes to this end will be apparent to a person having ordinary skill in the art. This may include but is not limited to sealing using an additional elastomeric or non-elastomeric material, such as a transparent or opaque rubber, plastic or polymeric material but not limited thereto.

It will be appreciated by those skilled in the art that changes could be made to the embodiments described above without departing from the broad inventive concept thereof. It is understood, therefore, that the invention disclosed herein is not limited to the particular embodiments disclosed, and is intended to cover modifications within the spirit and scope of the present invention.

What is claimed is:

1. A bumper plate comprising:

a rim;

a hub;

a collar positioned radially inside the hub, the collar comprising an opening in a center thereof configured to receive a bar for lifting the bumper plate for weight training exercises;

a solid body comprising an elastomeric material extending between the rim and the hub, the elastomeric material forming a shock absorber region in the body, the elastomeric material being solid between the rim and the shock absorber region and between the shock absorber region and the hub, the shock absorber region comprising a plurality of spaced holes therein for absorbing noise generated when the bumper plate is dropped on a hard surface, the plurality of spaced holes forming at least one concentric row within the solid body, the solid body comprising an axial thickness smaller than that of the rim and the hub, wherein a distance between the rim and an outermost edge of the shock absorber region is between 5 inches and 7.5 inches, the outermost edge of the shock absorber region defined by a circle contacting a point of each of the plurality of spaced holes which is closest to the rim; and wherein the bumper plate has a size and shape configured to be stacked adjacent to at least one other bumper plate when mounted on the bar.

2. The bumper plate of claim 1, wherein the plurality of spaced holes comprises one or more of the following shapes: hexagonal, circular, square, triangular, trapezoidal or irregular shape.

3. The bumper plate of claim 2, wherein at least some of the plurality of spaced holes in the shock absorber region in the body pass partially through the elastomeric material.

4. The bumper plate of claim 3, wherein said plurality of spaced holes in the shock absorber region in the body comprises a plurality of holes that pass partially through the elastomeric material, and at least two such holes open in opposite directions.

5. The bumper plate of claim 1, wherein the plurality of spaced holes are arranged in two or more concentric rows.

6. The bumper plate of claim 1, wherein the shock absorber region is located in the middle of the body.

7. The bumper plate of claim 1, wherein the radius of the bumper plate is greater than or equal to 222.25 mm.

8. The bumper plate of claim 1, wherein the opening in the center of the collar is at least one inch (25.4 mm) in radius.

9. The bumper plate of claim 1, wherein the elastomeric material is one or more of rubber, pressed crumb rubber, polyurethane or mixtures thereof.

10. The bumper plate of claim 1, wherein at least some of the plurality of spaced holes are greater than 12.7 mm wide in cross-section.

11. The bumper plate of claim 1, wherein the elastomeric material has durometer hardness in the range of 60 to 90.

12. The bumper plate of claim 1, wherein at least some of the plurality of spaced holes are pass-through holes.

13. The bumper plate of claim 1, wherein the rim and the body of the bumper plate are made of the same elastomeric material.

14. The bumper plate of claim 1, comprising at least one additional elastomeric material, each elastomeric material having a different durometer hardness.

15. A bumper plate comprising:

a rim;

a hub;

a collar positioned radially inside the hub, the collar comprising an opening in a center thereof configured to receive a bar for lifting the bumper plate for weight training exercises;

a solid body made of an elastomeric material having a durometer in the range of 60 to 90 and extending between the rim and the hub, the elastomeric material forming a shock absorber region in the solid body, the elastomeric material being solid between the rim and the shock absorber region and between the shock absorber region and the hub, the shock absorber region comprising a plurality of spaced holes therein for absorbing noise generated when the bumper plate is dropped on a hard surface, the plurality of spaced holes forming at least one concentric row within the solid body;

wherein a distance between the rim and an outermost edge of the shock absorber region is between 5 inches and 7.5 inches, the outermost edge of the shock absorber region defined by a circle contacting a point of each of the plurality of spaced holes which is closest to the rim; and wherein the bumper plate has a size and shape configured to be stacked adjacent to at least one other bumper plate when mounted on the bar.

16. The bumper plate of claim 15, wherein the plurality of spaced holes comprises one or more of the following shapes: hexagonal, circular, square, triangular, trapezoidal or irregular shape.

17. The bumper plate of claim 16, wherein at least some of the plurality of spaced holes in the shock absorber region in the body pass partially through the elastomeric material.

18. The bumper plate of claim 15, wherein the shock absorber region is located in the middle of the solid body.

* * * * *